US005104249A

United States Patent [19]

Elsner et al.

[11] Patent Number: 5,104,249

[45] Date of Patent: Apr. 14, 1992

[54] WRITING TIP FOR A BALL POINT PEN

[75] Inventors: Horst Elsner, Nüremberg; Horst Hülsenbeck, Markt Bibart, both of Fed. Rep. of Germany

[73] Assignee: J.S. Staedtler GmbH & Co., Nüremberg, Fed. Rep. of Germany

[21] Appl. No.: 459,691

[22] PCT Filed: May 25, 1989

[86] PCT No.: PCT/DE89/00327

§ 371 Date: Jan. 26, 1990

§ 102(e) Date: Jan. 26, 1990

[87] PCT Pub. No.: WO89/11977

PCT Pub. Date: Dec. 14, 1989

[30] Foreign Application Priority Data

Jun. 2, 1988 [DE] Fed. Rep. of Germany ..... 3818786

[51] Int. Cl.[5] ..... B43K 7/10

[52] U.S. Cl. ..... 401/216

[58] Field of Search ..... 401/216

[56] References Cited

U.S. PATENT DOCUMENTS

| | | | |
|---|---|---|---|
| 3,166,618 | 1/1965 | Fehling et al. . | |
| 3,230,935 | 1/1966 | Fehling et al. | 401/216 |
| 4,116,569 | 9/1978 | Reed et al. | 401/216 |
| 4,134,199 | 1/1979 | Liguori | 401/216 X |

FOREIGN PATENT DOCUMENTS

| | | | |
|---|---|---|---|
| 177350 | 6/1953 | Austria | 401/216 |
| 394866 | 12/1965 | Fed. Rep. of Germany | 401/216 |
| 2034274 | 1/1972 | Fed. Rep. of Germany . | |
| 2148970 | 6/1972 | Fed. Rep. of Germany | 401/216 |
| 2115043 | 10/1972 | Fed. Rep. of Germany | 401/216 |
| 2854604 | 6/1979 | Fed. Rep. of Germany | 401/216 |
| 972100 | 1/1951 | France | 401/216 |
| 1049325 | 12/1953 | France | 401/216 |
| 564172 | 9/1944 | United Kingdom | 401/216 |

*Primary Examiner*—Steven A. Bratlie
*Attorney, Agent, or Firm*—Toren, McGeady & Associates

[57] ABSTRACT

A writing tip for ball point pens include a receiving bore for a writing ball worked into the tip housing, a circumferential support surface inclined towards a central feed bore and arranged between same and with receiving bore, feed channels discharging into the central feed bore and into the support surface and spherically-shaped support zones adapted to the ball. Capillarity increasing intermediate surfaces respectively between the spherically-shaped support zones and the feed channels.

17 Claims, 4 Drawing Sheets

WRITING TIP FOR A BALL POINT PEN

BACKGROUND OF THE INVENTION

1. Field of the Invention

The invention is directed to a writing tip for a ball point pen with a ball receiving bore for a writing ball worked into the tip housing, with a circumferential support face inclined towards a central feed bore and arranged between this feed bore and the receiving bore with supply channels discharging into the central feed bore and into the support surface and with spherically-shaped support zones matched to the ball.

2. Description of the Related Art

Such writing tips are known. The DE-OS 20 34 274 shows a receiving bore with its support face circumferentially located around a central ink feed bore which is penetrated buy several ink feed channels. A circumferential support zone is worked into the support surface in such a way that its individual components located on the segments between the feed channels are in contact beyond the feed channels and cover these feed channels partially toward the writing ball. This construction has several disadvantages. To begin with, the contact surface between the ball and the support zone is overall relatively large, which results in a consequent rolling resistance of the ball. On the other hand, because of the partial covering of the feed channels with respect to the ball, an interruption of the writing agent feed can easily occur, which results in failures, because the lubrication provided by the writing agent is no longer present.

A writing tip for a ball point pen is known from the U.S. Pat. No. 3,166,618 where the support zones are located on raised spots, provided upon a circumferential support surface and which form paste supply lines between themselves. In this case the rolling resistance of the support zones against the ball is lower.

A disadvantage of this construction however is that the intermediate surfaces located between the support zone and the support surface fall off relatively steeply from the spherical support zone and thus from the surface of the ball. Therefore, the transition between the zone of this feed bore and the feed lines having a relatively low capillarity and the support zones forming the ball receptacle acting in a high capillarity manner, is very abrupt, which has also a negative effect upon the writing behavior and the lubrication.

SUMMARY OF THE INVENTION

Thus it is the task of the invention to create a writing tip for a ball point pen and to shape it in such a way that a low rolling resistance between the support zone and the writing ball is combined with an optimum lubrication of this area, so that a favorable writing behavior without failures and dry runs of the ball is achieved with different writing agents, pasty agents, as well as aqueous inks.

This task is solved by providing capillarity increasing intermediate surfaces arranged between the spherically-shaped support zones and the feed channels.

An optimum lubrication of the writing ball is combined in the invention with a low rolling resistance of the ball upon the support zone by means of the capillarity increasing intermediate surfaces located between the spherically designed support zones and the feed channels. It has been seen that the surface inclination a of the circumferential support surface should amount to 45° to 60° preferably to 48° to 53° referred to the central axis of the receiving bore. The capillarity increasing intermediate surfaces, which can be flat, as well as convex or concave, extend in one embodiment parallel to the support surface and along two feed channels lying next to each other wherein they are inclined towards these feed channels. Their peripheral inclination b with respect to the axis of the feed channels or the axis of the feed bore of the writing tip should amount to between 91° and 105°, preferably it should lie between 92° and 97°.

Two capillarity increasing intermediate zones are respectively arranged in another embodiment between the support zones and the supply feed channels, which intermediate zones can partially discharge into the spherical support zones.

In another embodiment, an intermediate surface is arranged respectively between two feed channels. This surface essentially covers the segment of the circumferential support face existing between the channels in the inner region. In this preferred embodiment, each zone is embraced at least from three sides by respectively one intermediate surface. Also according to this second embodiment form each support zone can be peripherally arranged essentially in the center of an associated intermediate surface and can be radially in direct connection with the feed bore.

It was seen to be expedient in both embodiments to have the intermediate surface discharge into the capillarity increasing narrowed channel segments of the channels. The spherical support zone should have a depth of 0.008 to 0.02 mm.

BRIEF DESCRIPTION OF THE DRAWING

In the following the invention is described with particularity with the help of two embodiment forms.

The drawing shows in.

DESCRIPTION OF THE PREFERRED EMBODIMENTS

Figure 1:
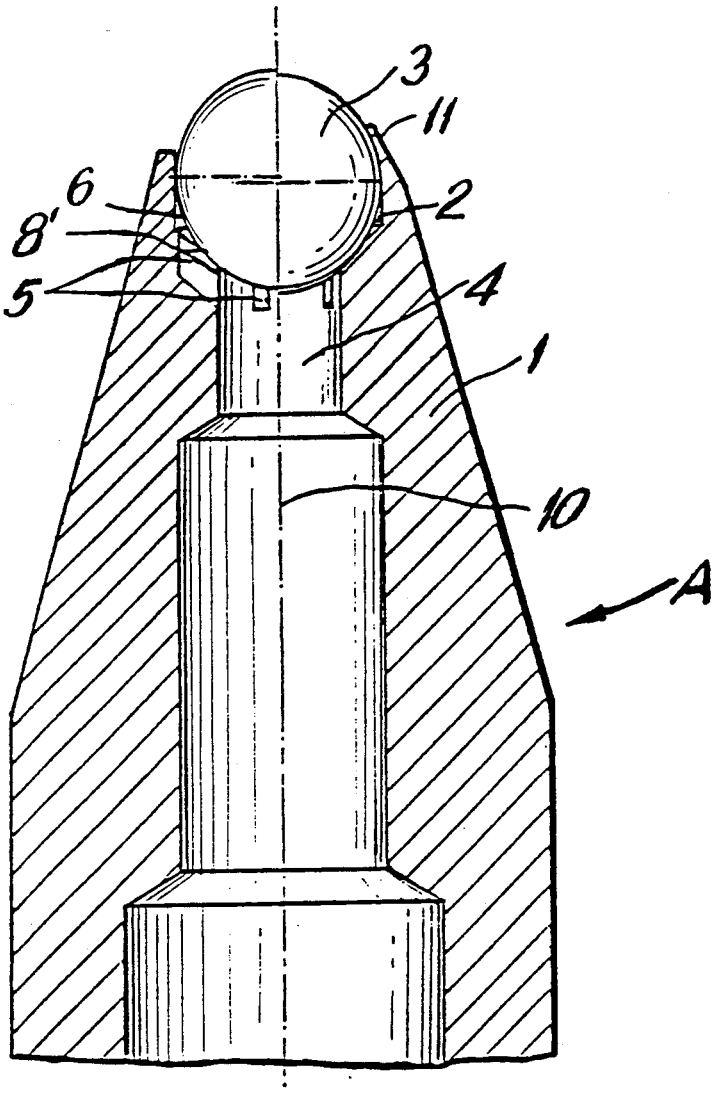
FIG. 1 a writing tip according to a first embodiment with the writing ball inserted, FIG. 2 the front region of the writing tip in FIG. 1 without the writing ball, FIG. 3 a plan view on FIG. 2, FIG. 4 the feed channel with support surfaces according to FIGS. 1 to 3, FIG. 5 a writing tip in accordance with a second embodiment with the writing ball inserted, FIG. 6 the front region of the writing tip in FIG. 5 without the writing ball, FIG. 7 a plan view on FIG. 6.
Figure 2:
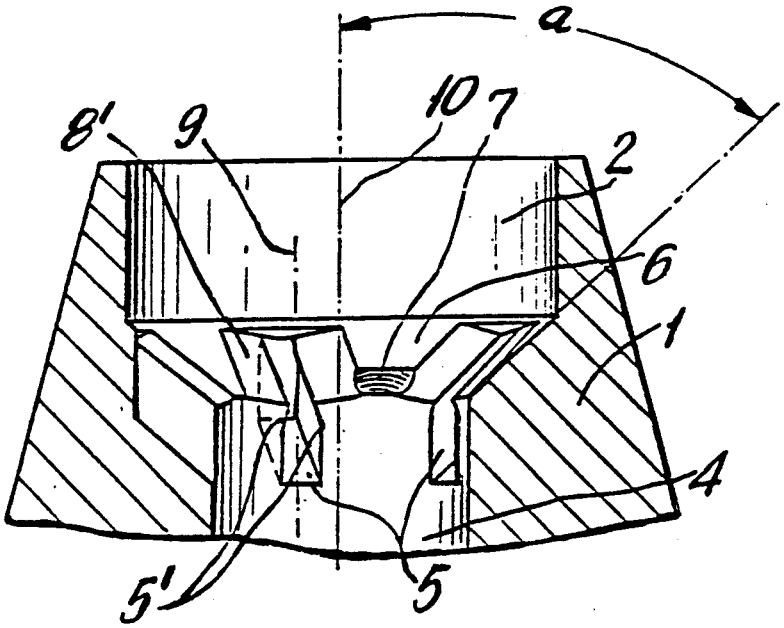

The writing tip A depicted in FIG. 1 comprises a tip housing 1 and a writing ball 3. A receiving bore 2 for the writing ball 3 is located in the tip housing 1, followed by a central feed bore 4 for the writing agent, which extends axially rearward. The transition from the receiving bore 2 and the feed bore 4 is constituted by a circumferential inwardly inclined support surface 6. The support surface 6 is interrupted by several feed channels 5 for the writing agent which extend axially rearward away from the support surface and discharge into the feed bore 4 from where they extend radially outward. The support zones 7 upon which the writing balls 3 rest are located on the support surface 6. The writing ball 3 is retained towards the front end in the receiving bore by a retaining edge 11. FIG. 2 shows the receiving bore 2 and the supply bore 4 with the support surface 6 arranged between the bores at an angle a.

Several feed channels 5 penetrate the support surface 6 axially rearward and discharge into the feed bore 4. Support zones 7 are located respectively between two feed channels 5 in the front region of the support surface 6 which have a spherical shape adapted to the surface of the writing ball 3.

The capillarity increasing intermediate surfaces 8' are arranged in between the support zones 7 and the feed channels 5, which intermediate surfaces are inclined downwards towards the feed channels 5 and extends in radial direction essentially parallel to the support surface 6. The intermediate surfaces 8' can transit into the support zones 7.

If now a writing ball is present in the receiving bore 2 and is held by the receiving edge 11 with slight clearance upon the support zone 7, there results in between the surface of the ball an the intermediate surfaces 8' a zone of high capillarity increasing towards the support zone 7, through which the writing agent is literally sucked from the feed channels 5 into between the ball surface and the support zone 7. The writing ball 2 floats upon a thin film of writing agent, wherein the lubrication achieved in this manner and the small contact surface keep the rolling resistance of the writing ball low and assure that the writing ball is supplied with writing agent.

Figure 3:
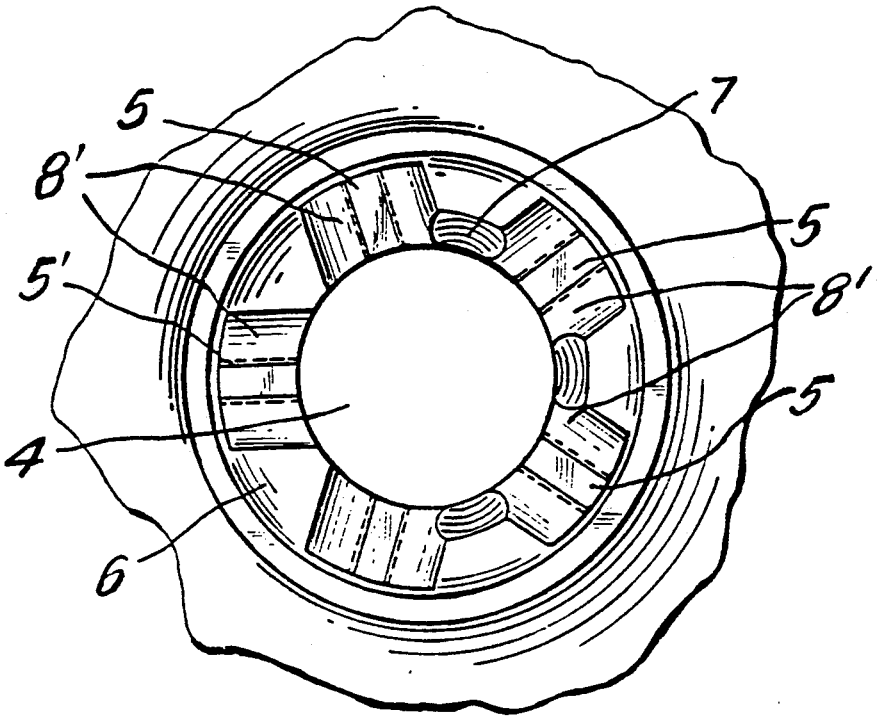

It can be seen in FIG. 3 how the support surface 6 is interrupted by the feed channels 5, how the support zones 7 are located in the front towards the feed bore 4 upon the support surface 6, wherein the intermediate surfaces 8' extend respectively between the support zones 7 and the feed channels 5. The intermediate surfaces 8' and the support zones 7 transit into each other.

Figure 4:
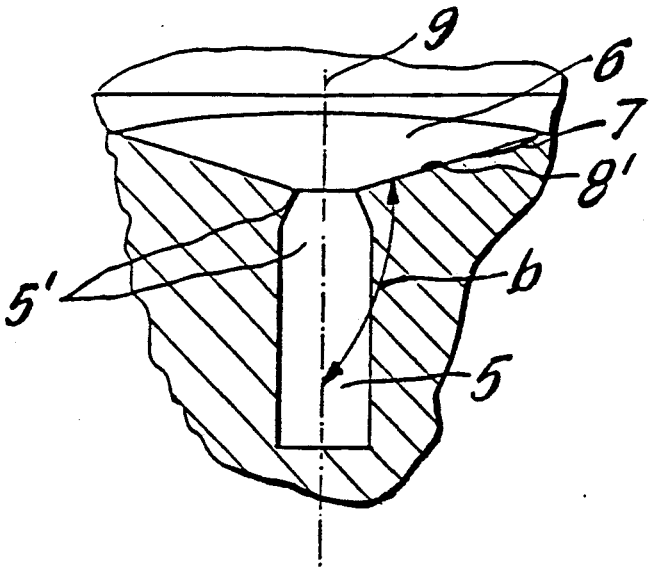

FIG. 4 shows diagrammatically the sequence of support zone 7, intermediate surface 8' and feed channel 5. The angle b between this intermediate surface 8' and the central axis 9 of the feed channel 5 is to amount to between 91° and 105°. A narrowed down channel segment 5' can in addition be provided respectively at the transition of the feed channel 5 to the intermediate surfaces 8' for better supply of writing agent.

Figure 5:
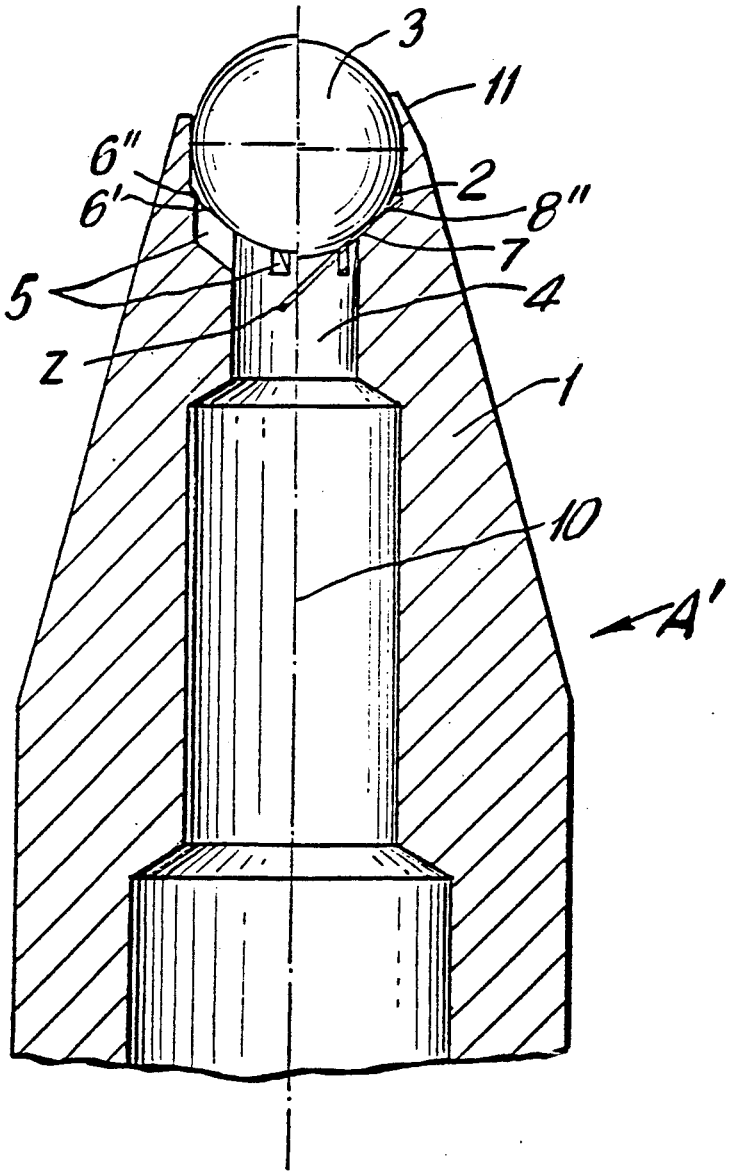

FIG. 5 shows a writing tip A' with tip housing 1 and writing ball 3. The tip housing 1 has a receiving bore 2, a central bore 4 for the writing agent and, in the transition between the receiving bore 2 and the feed bore 4, an inner region 6' and an outer region 6'' of a circumferential support face 6 inclined inwardly. The support surface 6 is interrupted by several feed channels 5 for the writing agent, which discharge into the supply bores. The writing ball 3 rests upon the support zones 7 and is maintained in this position by a retaining edge 11 at the front end.

Figure 6:
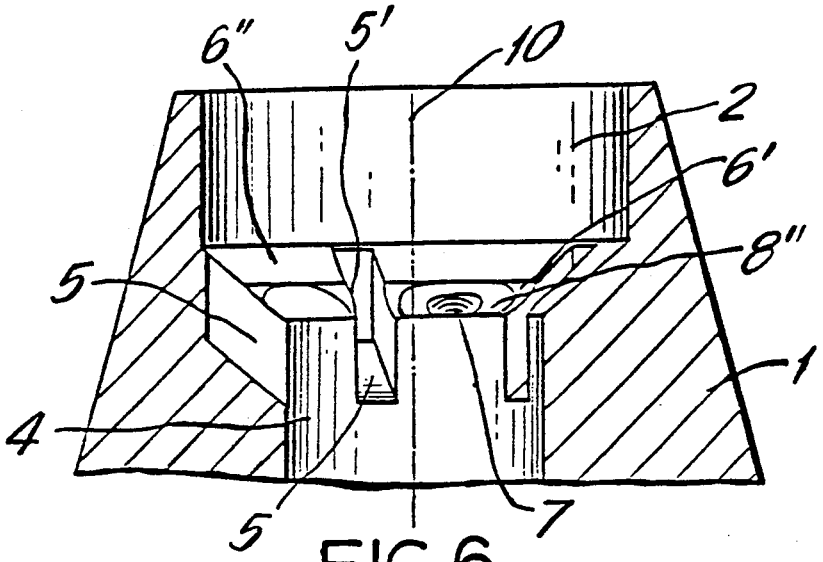

The front part of the seating housing 1 with receiving bore 2, feed bore 4 and the support surface 6 can be seen in FIG. 6. The support surface 6 has in this version a circumferential outer region 6'' which is inclined directly inward just as the support zone in the first embodiment example. The inner region 6' of the support surface 6 which follows directly upon the outer region 6'', has a spherical form arched inwardly. The support surface 6 is penetrated by several feed channels 5 which extend axially rearward and discharge into the feed bore 4. Intermediate surfaces 8'' are arranged upon the inner region 6' of the support surface 6 between these individual feed channels 5 in such a way that they cut as planes through the spherical shape of the inner region 6' of the support zone 6, so that faces raised relative to the inner region 6' of the support zone 6 result between these feed channels 5 and at a small spacing therefrom; these raised faces acting as intermediate surfaces 8'' serve for increase of the capillarity between the feed channels 5 and the support zones 7; wherein the support zones 7 are then surrounded on three sides by an intermediate surface 8'' and towards the fourth side are directly connected with the central feed bore 4. This type of construction provides also zones of high capillarity increasing towards the support zone 7 and, thus, towards the contact surface of the writing ball, between the writing ball 3 and the intermediate surfaces 8''; this capillarity literally sucks the writing agent out of the feed channels 5 into the zone of high capillarity between the writing ball 3 and the support zone 7. It results from this construction that the writing ball floats continuously upon a thin film of writing agent which does not tear off, which always provides good lubrication to the writing ball and also results in a good writing behavior because of the small contact surfaces involving a low rolling resistance.

In this second embodiment narrowed down channel segments 5' can advantageously be arranged at the transition of the feed channels 5 to the inner regions 6' of the support surface, which constricted channel segments improve the writing agent flow out of the feed channels 5 into the inner region 6' of the support surface.

Figure 7:
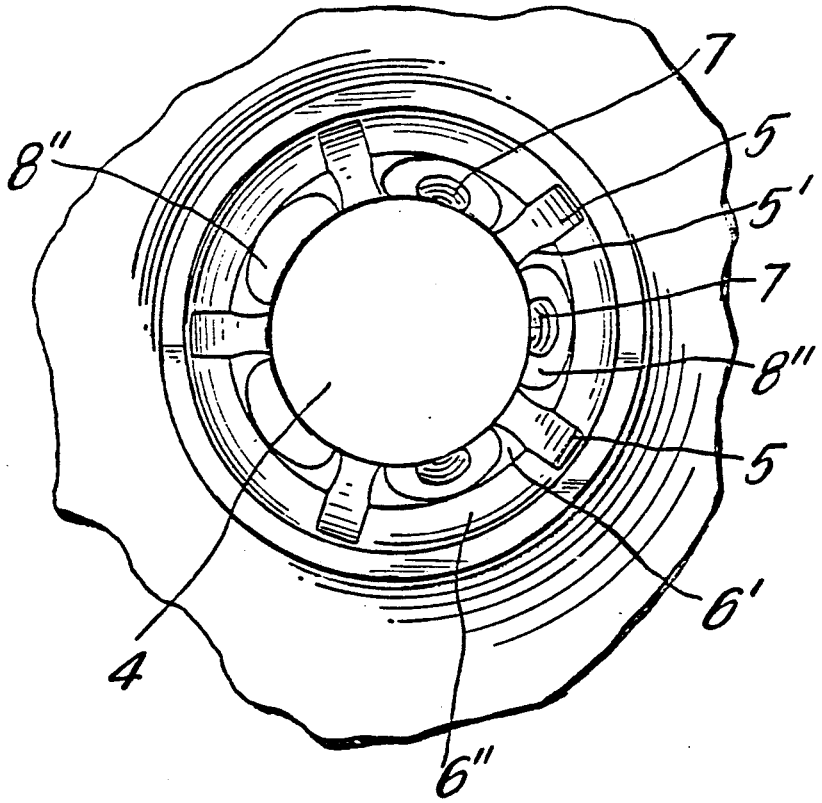

FIG. 7 shows how the support surface 6 is subdivided into an outer region 6'' and an inner region 6', wherein the support surface is altogether penetrated by several feed channels 5. The intermediate surfaces 8'' are located on the inner region 6' of the support surface 6, in the middle of which intermediate surfaces lie respectively the support zones 7 which are surrounded on three sides by an intermediate surface and which discharge on the fourth side directly into the central feed bore 4.

The left half of the FIGS. 1 and 5 show respectively a writing tip A, A' where the ball 3 has not yet been pressed in and serrated in place, while the righthand half respectively depicts the pressed in ball with the serrated writing tip. The respective concave support zones 7 with their depth z result basically only during or after the pressing in and serrating in place process of the ball 3.

We claim:

1. In a writing tip for ball point pens including a tip housing (1), a receiving bore (2) for a writing ball (3) in the tip housing (1), a circumferential support surface (6) inclined towards a central feed bore (4) and arranged between the central feed bore (4) and the receiving bore (2), feed channels (5) discharging into the central feed bore (4) and into the support surface (6) and spherically-shaped support zones (7) adapted to the ball (3), the improvement comprising capillarity increasing intermediate surfaces 8', 8'' extending between the spherically-shaped support zones (7) and the feed channels (5).

2. Writing tip according to claim 1, wherein the plane slope (a) of the circumferential support surface (6) with respect to the central axis (10) amounts to 45° to 60°.

3. Writing tip according to claims 1 or 2, wherein the intermediate surfaces (8', 8'') are flat surfaces.

4. Writing tip according to claims 1 or 2, wherein the intermediate surfaces (8', 8'') are shaped to extend with concavity.

5. Writing tip according to claim 1, wherein respectively two intermediate surfaces (8') are arranged as capillarity increasing zones, the intermediate surfaces (8') extending parallel to the support face (6) as well as along two feed channels (5) lying next to each other inclined relative to the feed channels (5).

6. Writing tip according to claim 1, wherein a peripheral slope (b) of the intermediate surfaces (8') oriented to the adjacent feed channel (5) amounts to between 90° and 105° with respect to the axis (9) of said feed channel (5) and with respect to the central axis (10) of the writing tip (A).

7. Writing tip according to claim 1, wherein the intermediate surfaces (8') extend at least partially into the spherical support zones (7).

8. Writing tip according to claim 1, wherein one intermediate surface each (8'') is arranged between two feed channels (5).

9. Writing tip according to claim 8, wherein the intermediate surface (8'') essentially covers a segment of the circumferential support surface (6) in the inner region (6') which extends between the channels (5).

10. Writing tip according to claim 8, wherein each support zone (7) is surrounded on at least three sides by one intermediate surface (8'').

11. Writing tip according to claim 8, wherein each support zone (7) is arranged peripherally essentially in the center of an associated intermediate surface (8'') and is radially in direct connection with the feed bore (4).

12. Writing tip according to claim 1, wherein the intermediate surfaces (8', 8'') discharge into capillarity increasing narrowed down channel segments (5') of the feed channels (5).

13. Writing tip according to claim 1, wherein the spherical support zones (7) comprise a depth (z) of 0.005 to 0.05 mm.

14. Writing tip according to claim 2, wherein the plane slope (a) is 48° to 53°.

15. Writing tip according claims 1 or 2, wherein the intermediate surfaces (8', 8'') are shaped to extend with convexity.

16. Writing tip according to claim 6, wherein the peripheral slope (b) is between 92° and 97°.

17. Writing tip according to claim 13, wherein the depth (z) of the spherical support zones (7) is 0.008 to 0.02 mm.

* * * * *